US008861760B2

(12) United States Patent
Strelcyk

(10) Patent No.: US 8,861,760 B2
(45) Date of Patent: Oct. 14, 2014

(54) AUDIO PROCESSING COMPRESSION SYSTEM USING LEVEL-DEPENDENT CHANNELS

(75) Inventor: Olaf Strelcyk, Oakland, CA (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 193 days.

(21) Appl. No.: 13/269,232

(22) Filed: Oct. 7, 2011

(65) Prior Publication Data

US 2013/0089228 A1 Apr. 11, 2013

(51) Int. Cl.

| | |
|---|---|
| ***H04R 25/00*** | (2006.01) |
| *G10L 21/00* | (2013.01) |
| *G10L 19/00* | (2013.01) |

(52) U.S. Cl.
USPC ..... 381/321; 704/224; 704/500

(58) Field of Classification Search
USPC ..... 381/321, 312, 106, 107, 104, 314, 320; 700/225, 500, 200, 224
See application file for complete search history.

(56) References Cited

U.S. PATENT DOCUMENTS

| | | | | |
|---|---|---|---|---|
| 3,784,750 | A | 1/1974 | Stearns et al. | |
| 4,701,953 | A * | 10/1987 | White | 704/226 |
| 6,236,731 | B1 | 5/2001 | Brennan et al. | |
| 6,868,163 | B1 | 3/2005 | Goldstein | |
| 2007/0165891 | A1 | 7/2007 | Bramslow et al. | |
| 2008/0144869 | A1 * | 6/2008 | Paludan-Mueller et al. | 381/320 |
| 2008/0175422 | A1 | 7/2008 | Kates | |
| 2012/0278087 | A1 * | 11/2012 | Hosokawa | 704/500 |

OTHER PUBLICATIONS

Carney, L. H, "A model for the responses of low-frequency auditory-nerve fibers in cat", J Acoust Soc Am., 93(1), (Jan. 1993), 401-17.

Kates, James M, "Chapter 2: Signal Processing Basics", Digital Hearing Aids, Plural Publishing, (2008), 17-50.

Kates, James M, "Chapter 8: Dynamic-Range Compression", Digital Hearing Aids, Plural Publishing, (2008), 221-262.

Lopez-Poveda, E. A, et al., "A human nonlinear cochlear filterbank", J Acoust Soc Am., 110(6), (Dec. 2001), 3107-18.

Zhang, X., et al., "A phenomenological model for the responses of auditory-nerve fibers: I. Nonlinear tuning with compression and suppression.", J Acoust Soc Am., 109(2), (Feb. 2001), 648-70.

European Application Serial No. 12187331.9, Extended European Search Report mailed Feb. 15, 2013, 7 pgs.

European Application Serial No. 12187331.9, Response filed Oct. 10, 2013 to Extended European Search Report mailed Feb. 15, 2013, 12 pgs.

* cited by examiner

*Primary Examiner* — Curtis Kuntz
*Assistant Examiner* — Sunita Joshi
(74) *Attorney, Agent, or Firm* — Schwegman Lundberg & Woessner, P.A.

(57) ABSTRACT

Disclosed herein, among other things, are methods and apparatus for a level-dependent compression system for hearing assistance devices, such as hearing aids. The present subject matter includes a hearing assistance device having a buffer for receiving time domain input signals and a frequency analysis module to convert time domain input signals into a plurality of subband signals. A power detector is adapted to receive the subband signals and to provide a subband version of the input signals. A nonlinear gain stage applies gain to the plurality of subband versions of the input signals, and a frequency synthesis module processes subband signals from the nonlinear gain stage and to create a processed output signal. The device also includes a filter for filtering the signals, and a level-dependent compression module. The level-dependent compression module is adapted to provide bandwidth control to the plurality of subband signals produced by the frequency analysis stage.

20 Claims, 4 Drawing Sheets

AUDIO PROCESSING COMPRESSION SYSTEM USING LEVEL-DEPENDENT CHANNELS

FIELD OF THE INVENTION

The present subject matter relates generally to audio processing devices and hearing assistance devices, such as audio limiters, audio compressors, hearing aids, and in particular to a level-dependent compression system for audio processing and hearing assistance devices.

BACKGROUND

In the past, single-channel as well as multi-channel audio amplification systems have been devised to compress the dynamic range of audio signals. However, both types of systems suffer from different, mutually exclusive limitations. Single-channel systems preserve spectral contrast but cannot provide adequate frequency-dependent compressive gain. In addition, such systems unnecessarily suppress or distort signal information in situations with low signal-to-noise ratios, where strong interfering components in remote frequency regions can control the gain. For the same reason, steady background sounds can acquire an objectionable modulation in the presence of fluctuating foreground sounds. Multi-channel systems, on the other hand, can provide frequency-dependent compression and can ensure audibility of weak signal components in the presence of wideband interferers if these systems are sufficiently fast-acting. However, by reducing spectral contrast across channels, they diminish spectral pattern information.

One place where this is observed is in hearing correction devices, such as hearing aids. Persons with sensorineural hearing loss experience reduced sensitivity to faint, low-level sounds and loudness recruitment, i.e., an abnormally steep growth of perceived loudness with sound level. In addition, due to the partial loss of frequency-dependent compressive gain in the impaired auditory system, the level-dependent auditory frequency tuning is affected. Compared to the normally-functioning auditory system, the tuning is particularly degraded at low sound levels resulting in a more static tuning as a function of level. One goal of assistive technology is to compensate for these consequences of sensorineural hearing loss, in order to improve perceived sound quality and aided performance of hearing-impaired listeners on advanced auditory functions such as speech or music perception in complex auditory environments. However, conventional single-channel and multi-channel systems suffer from the aforementioned problems, which sometimes can even compound the difficulties experienced by hearing-impaired listeners. The reduction of spectral contrast by multi-channel systems, for example, will only exacerbate the challenges faced by the impaired auditory system with its degraded frequency resolution.

FIG. 1 illustrates a basic prior art compression system. In the first stage, the incoming signal is buffered and spectrally analyzed, for example by using an FFT, warped FFT, or a time-domain filter-bank analysis (e.g., Kates, J. M., 2008, "Digital Hearing Aids," Plural Publishing, San Diego, Calif.). Next, typically the signal power or signal envelope (for brevity, only signal power is referred to in the following) in each band is estimated by a power detector and smoothed by a power integrator which informs the subsequent gain calculation (throughout this application, "band" refers to static spectral bands). This gain is then applied to the individual band signals and the overall signal is re-synthesized by using an inverse FFT or a synthesis filter bank in conjunction with overlap add synthesis. FIG. 2 shows an alternative prior art implementation where the compressive-gain calculation is "side-branched", with the compressive-gain filter transformed into the time domain and applied via time-domain convolution.

Static hybrid systems such as the one devised by White in U.S. Pat. No. 4,701,953 entitled "Signal Compression System" (1987), use broadly overlapping analysis filters for envelope/power detection and narrow synthesis filters, preserve spectral contrast and provide frequency-dependent gain functions, but still fail to provide adequate signal gain in situations with low signal-to-noise ratios.

What is needed in the art is a way to provide level-dependent processing of sounds that optimizes both spectral contrast and gain.

SUMMARY

Disclosed herein, among other things, are methods and apparatus for a level-dependent compression system for audio processing and hearing assistance devices, such as audio limiters, audio compressors, and hearing aids. The present subject matter includes a hearing assistance device having a buffer adapted for receiving time domain input signals and a frequency analysis module adapted to convert the time domain signals into a plurality of subband signals. A power detector is adapted to receive the subband signals and to provide a subband version of the input signals. The hearing assistance device includes a nonlinear gain stage adapted to apply gain to the plurality of subband versions of the input signals, and a frequency synthesis module adapted to process subband signals from the nonlinear gain stage and to create a processed output signal. The device also includes a filter adapted for filtering the input signals and the output signal, and a level-dependent compression module. According to an embodiment, the level-dependent compression module is adapted to provide bandwidth control to the plurality of subband signals produced by the frequency analysis stage. The level-dependent compression module is adapted to add a weighted power of a first subband signal to at least one other weighted subband signal in an adjacent subband, and to provide a final instantaneous-power estimate, in an embodiment.

This Summary is an overview of some of the teachings of the present application and not intended to be an exclusive or exhaustive treatment of the present subject matter. Further details about the present subject matter are found in the detailed description and appended claims. The scope of the present invention is defined by the appended claims and their legal equivalents.

DETAILED DESCRIPTION

The following detailed description of the present subject matter refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is demonstrative and not to be taken in a limiting sense. The scope of the present subject matter is defined by the appended claims, along with the full scope of legal equivalents to which such claims are entitled.

The present subject matter includes method and apparatus for a level-dependent compression system for audio processing and hearing assistance devices, such as audio limiters, audio compressors, and hearing aids. The following examples will be provided for a hearing aid, which is only one type of hearing assistance device. It is understood however, that the disclosure is not limited to hearing aids and that the teachings provided herein can be applied to a variety of audio processing and hearing assistance devices.

The present invention relates to a signal compression system and method, particularly suitable for compression of audio signals such as speech and music. In various embodiments, the present subject matter provides the use of level-dependent analysis channels to control the compressive-gain signal as a function of frequency. In various embodiments, the present level-dependent analysis channels are channels with level-dependent bandwidths. In various embodiments, powers from bands of a static bandwidth are weighted and summed according to signal level to operate on an effectively broader frequency range than a single analysis band. In various applications, the level-dependent bandwidths are a function of signal level to provide compression as a function of frequency and signal level.

The present subject matter applies to compression systems using both uniformly and non-uniformly scaled analysis filterbanks. In addition, the present subject matter applies to compression systems using both unbranched and side-branched architectures.

In various embodiments, this system provides an improved solution for the trade-off dilemma between preserved spectral contrast and applying frequency-specific gain compared to prior systems. The present subject matter is useful in a variety of applications involving compression of signals generally.

Approaches Using Tunable Bands

Figure 3:
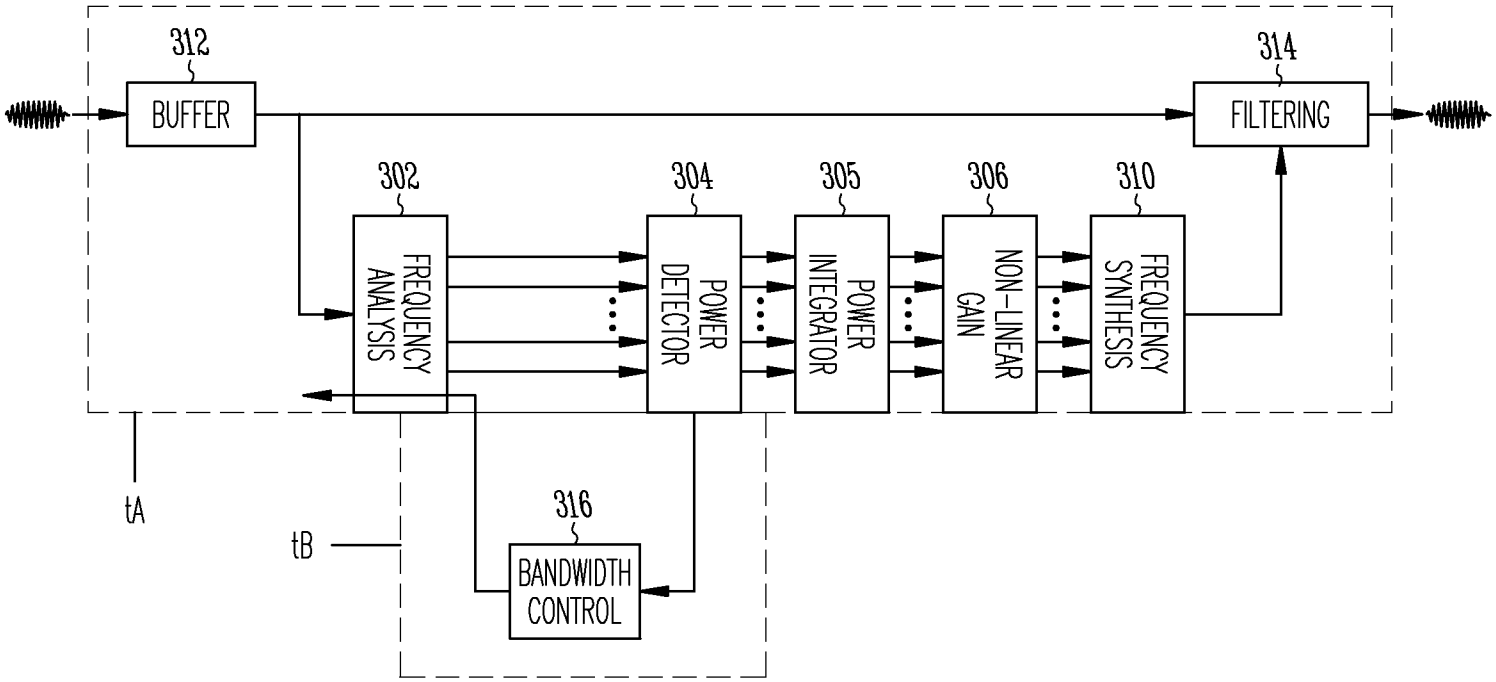
FIG. 3 is a level-dependent compression system using feedback bandwidth control according to one embodiment of the present subject matter.

FIG. 3 is a level-dependent compression system using feedback bandwidth control according to one embodiment of the present subject matter. In contrast to the prior approaches, the present level-dependent compression system provides tuning of the compression analysis channels that depends on the level of the incoming sound. In the system illustrated in FIG. 3, this is realized by changing the bandwidths of the initial frequency-analysis channels recursively, according to the power in each channel. In various embodiments, a feedback system is employed to perform bandwidth adjustment. For example, in various embodiments, the power in a given channel at a given time determines the bandwidth of that given channel at a later time. In one approach the bandwidth is updated for the next time frame (the immediately following time frame), corresponding to the embodiment in FIG. 3 with identical clocks tA and tB. In this embodiment, the bandwidth update lags the signal by one frame. In various embodiments, the bandwidth update is performed by a feedback loop cycling multiple times during a given frame (at a higher clock speed) to reduce or avoid the lag. In various embodiments, the feedback loop is down-sampled to allow the bandwidth to update every M frames (M is an integer greater than 1). This corresponds to the embodiment in FIG. 3 with clock tB running slower than clock tA. The bandwidth change can be implemented by changing filter parameters. In one embodiment, the bandwidth change is performed by changing parameters of finite impulse response (FIR) filters. In another embodiment, the bandwidth change is performed by changing parameters of infinite impulse response (IIR) filters.

The bandwidth-power function should be continuous, but does not need to be monotonous. Possible choices include, but are not limited to, sigmoid curves, piecewise linear, exponential or power-law functions. In various embodiments with feedback a maximum change in bandwidth with power, i.e., the maximum absolute slope of the bandwidth-power function, is limited such that, for a white-noise input, the change in bandwidth corresponding to a 1-dB change in power results in an additional change of within-channel power of less than 1 dB. This ensures that the feedback loop is stable and converging in time. It is understood that other bandwidth-power functions may be used without departing from the scope of the present subject matter.

FIG. 3 shows system 300 that includes a signal buffer 312 to receive input signals. In the embodiment of a hearing aid application, the input signal is acoustic information that is received by a transducer such as a microphone or radio receiver. In the embodiment of an audio processing application, the input signal is acoustic information that is received by a transducer, either in real-time or pre-recorded. The signal side-branches to a frequency analysis block 302 which generates sub-channel signals for power detector 304. The sub-channel signals are received by power detector 304 which provides power estimates as a function of frequency (or sub-channel) as input to bandwidth control 316. Based on the sub-channel power, the bandwidth control 316 calculates and updates the bandwidth-control parameters of the frequency analysis block 302. The sub-channel signals from power detector 304 are sent to power integrator 305 which smoothes the power signals in time to minimize distortion (e.g., the power integrator could be a one-pole low-pass filter). The smoothed signals from power integrator 305 are sent to non-linear gain 306, which calculates the gain according to prescriptive gain information for the wearer. The resulting sub-channel gains are converted to the time domain by frequency synthesis 310. The resulting output of frequency synthesis 310 is sent to filtering 314 which applies the time-domain filter to the signal from buffer 312. The output of filtering 314 is a processed sound using at least one embodiment of the present subject matter for level-dependent compression. Other configurations are possible and may vary without departing from the scope of the present subject matter.

Figure 4:
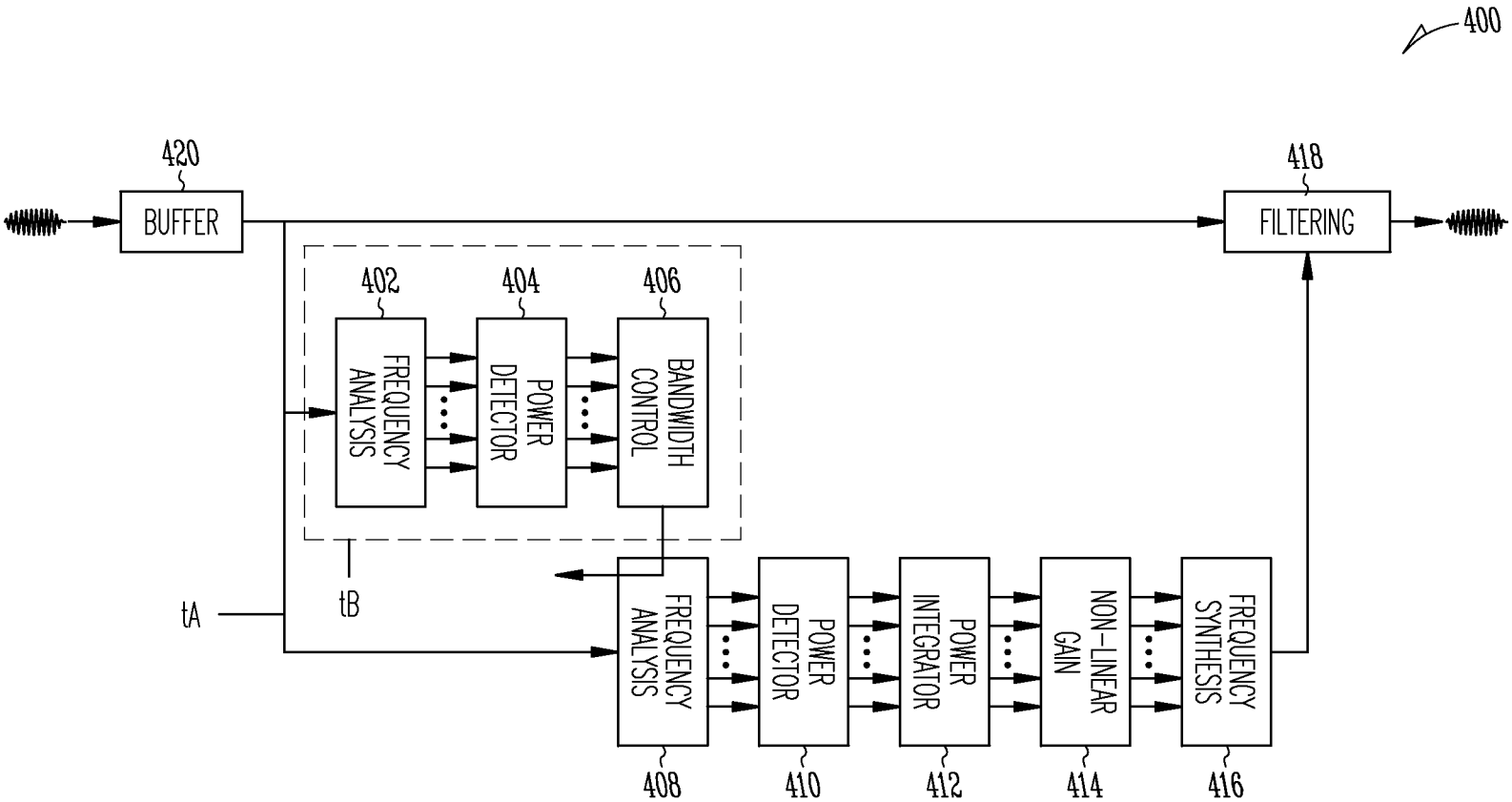
FIG. 4 is a level-dependent compression system using feed-forward bandwidth control according to one embodiment of the present subject matter.

FIG. 4 is a level-dependent compression system using feed-forward bandwidth control according to one embodiment of the present subject matter. This level-dependent compression system provides tuning of the compression analysis channels that depends on the level of the incoming sound. In the system illustrated in FIG. 4, this is realized by changing the bandwidths of the frequency-analysis channels non-recursively, according to the power within bands of a static filterbank In various embodiments, a feed-forward system is employed to perform bandwidth adjustment. For example, in various embodiments, the power in a given static band at a given time determines the bandwidth of the corresponding channel at the same time (this is the case in FIG. 4 with identical clocks tA and tB). In various embodiments, the feed-forward bandwidth control is down-sampled to allow the bandwidth to update every M frames (M is an integer greater than 1). This corresponds to the embodiment in FIG. 4 with clock tB running slower than clock tA. The bandwidth change can be implemented by changing filter parameters. In one embodiment, the bandwidth change is performed by changing parameters of finite impulse response (FIR) filters. In another embodiment, the bandwidth change is performed by changing parameters of infinite impulse response (IIR) filters.

The bandwidth-power function should be continuous, but does not need to be monotonous. Possible choices include, but are not limited to, sigmoid curves, piecewise linear, exponential or power-law functions. It is understood that other bandwidth-power functions may be used without departing from the scope of the present subject matter.

FIG. 4 shows system 400 that includes a signal buffer 420 to receive input signals. In the embodiment of a hearing aid application, the input signal is acoustic information that is received by a transducer such as a microphone or radio receiver. In the embodiment of an audio processing application, the input signal is acoustic information that is received by a transducer, either in real-time or pre-recorded. The signal side-branches to a frequency analysis block 402 which generates subband signals for power detector 404. The subband signals are received by power detector 404 which provides power estimates as a function of frequency (or subband) as input to bandwidth control 406. Based on the subband power, the bandwidth control 406 calculates and updates the bandwidth-control parameters of the frequency analysis block 408. Frequency analysis block 408 generates sub-channel signals for power detector 410 which provides power estimates as a function of frequency (or sub-channel) as input to power integrator 412. Power integrator 412 smoothes the power signals in time to minimize distortion. The smoothed signals from power integrator 412 are sent to non-linear gain 414, which calculates the gain according to prescriptive gain information for the wearer. The resulting sub-channel gains are converted to the time domain by frequency synthesis 416. The resulting output of frequency synthesis 416 is sent to filtering 418 which applies the time-domain filter to the signal from buffer 420. The output of filtering 418 is a processed sound using at least one embodiment of the present subject matter for level-dependent compression. Other configurations are possible and may vary without departing from the scope of the present subject matter.

Approaches Using Weighted Static Bands

Figure 1:
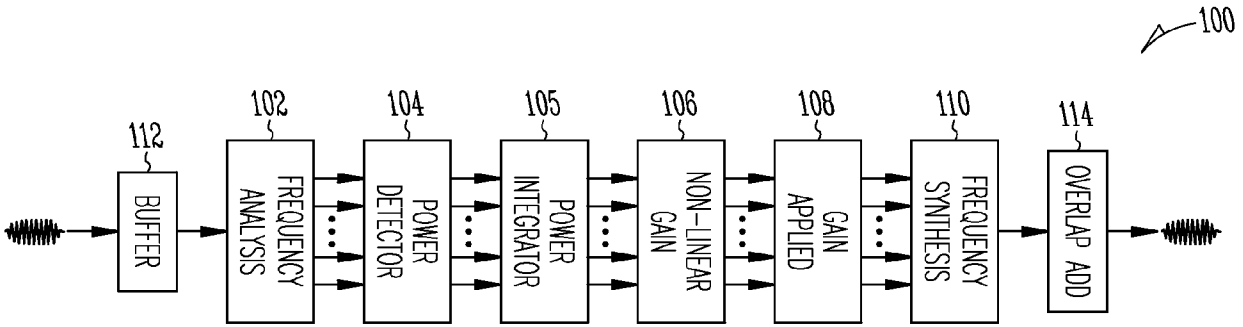
Fig.1 (Prior Art)
FIG. 1 is a basic compression system found in prior art devices.
Figure 2:
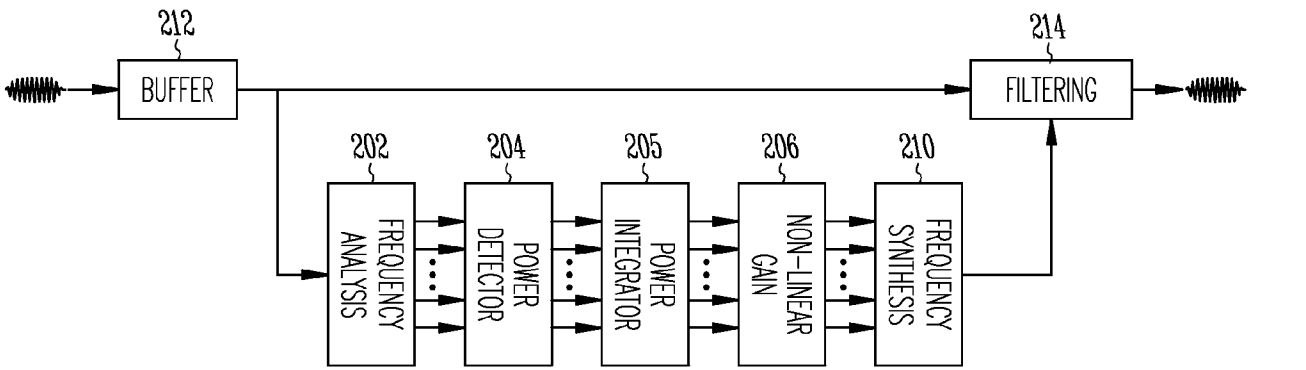
Fig.2 (Prior Art)
FIG. 2 is a side-branch compression system found in prior art devices.
Figure 5:
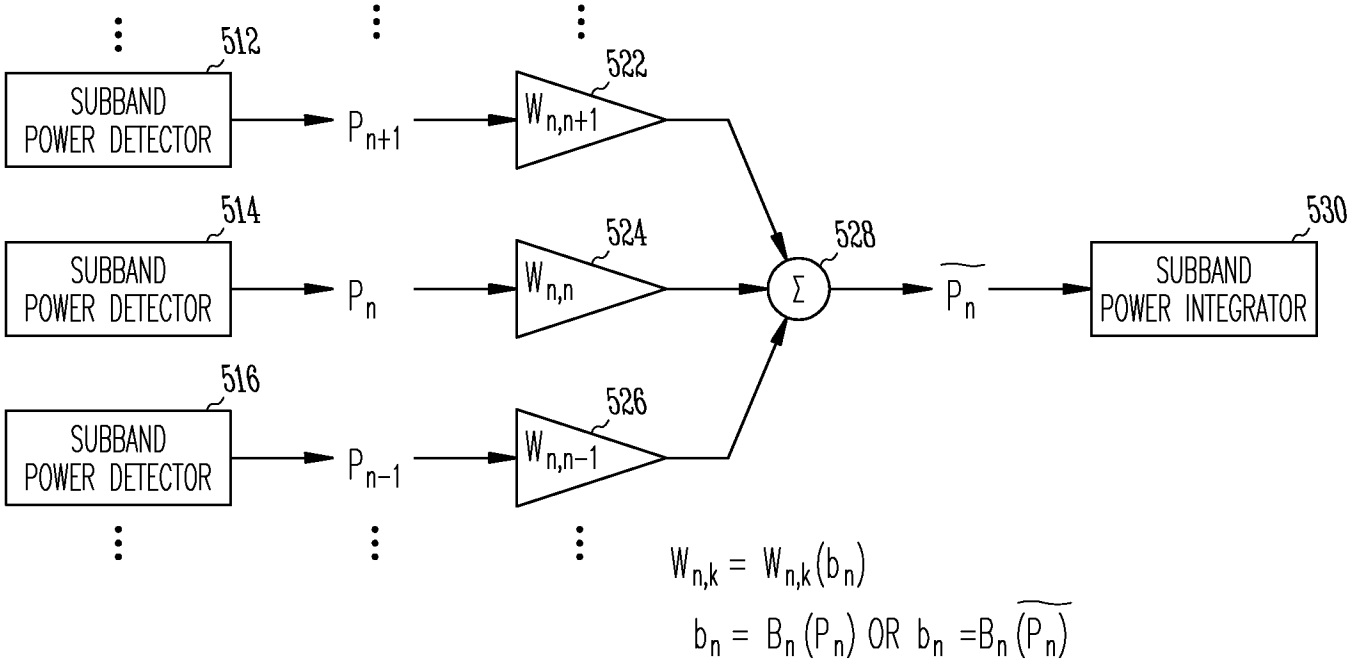
FIG. 5 is a power summation system for channel n of a static-filterbank level-dependent compression system using summation of a plurality of neighboring static bands, according to one embodiment of the present subject matter.

Alternatively, the frequency-analysis stage 202 can remain static as in FIG. 2, but instead using level-dependent filtering realized by a modified power detector 500, as illustrated in FIG. 5. For a given compression channel with number n, power estimates $P_n$ from the frequency-analysis band number n and its adjacent bands n−1, n−2, n+1, n+2, etc. are weighted and summed. This yields the instantaneous power $\tilde{P}_n$ in channel n. In this way, compression channel n operates on a wider frequency range than the single analysis band n. The weights $w_{n,k}$ for channel n are chosen as a function of the target bandwidth $b_n$ for this channel, according to the weight-bandwidth function: $w_{n,k}=W_{n,k}(b_n)$, with $w_{n,k} \in [0,1]$. The weights can be symmetrically or asymmetrically distributed across the lower and upper neighboring bands. For example, if non-zero weights were chosen only for band n and its higher-frequency neighbors (n+1, n+2, etc), channel n would be widened only to the high-frequency side.

Since the level-dependence of the bandwidths is realized through power summation, it is most convenient to measure the channel bandwidths in terms of equivalent rectangular bandwidths. If the bands in 202 have equal maximum pass-band transmission, the ERB of compression-channel n will be the weighted sum of the ERBs of the individual bands contributing to that channel, with weights $w_{n,k}$. The target bandwidth $b_n$ for channel n is given by the bandwidth-power function $B_n$, which should be continuous, but does not need to be monotonous. It is understood that other bandwidth-power functions may be used without departing from the scope of the present subject matter. There are two possible choices for the input received by the bandwidth-power function. The bandwidth can be chosen to depend on the channel power: $b_n=B_n(\tilde{P}_n)$, or, alternatively, to depend on the band power: $b_n=B_n(P_n)$. The former results in feedback bandwidth control while the latter results in a feed-forward bandwidth control.

In FIG. 5, the power estimates from a plurality of bands, including band n, from subband power detectors 512, 514, 516 are weighted ( . . . 522, 524, 526, . . . ) and summed with a summing node 528. The resulting instantaneous power $\tilde{P}_n$ is sent to the power integrator 530.

Another embodiment of the present subject matter includes a compression system which employs two parallel filterbank paths, one filterbank with narrow and one with broad channels, and then either weights and sums their corresponding power estimates with level-dependent weights or calculates two non-linear gain signals based on the power estimates from the two filterbanks and then weights and sums these gain signals with level-dependent weights. At low sound levels, for example, the gain is predominantly determined by the filterbank with narrow channels, while the gain at high sound levels is determined by the filterbank with broad channels.

Further Considerations

Compression speeds and bandwidth-power functions of the compression channels are chosen according to the objectives of the compression system. For example, the compression speed should mirror the rate of the information-carrying power fluctuations in the signal to be compressed, which can differ for speech and music. The present subject matter is not limited to the use of a particular compression speed or bandwidth-power function. However, various embodiments of the present subject matter include one or more of fast-acting compression (resolving phonemic level variations of speech) and/or channels widening with increasing level when the system is employed to compensate for hearing impairment. In various embodiments, time constants on the order of tens of milliseconds are employed to perform the fast-acting compression.

If the level-dependent compression channels are widened sufficiently with increasing level, the proposed level-dependent system will preserve spectral contrast for high-level portions of sound such as vowels and vowel-consonant transitions in speech which are coded in terms of spectral-pattern cues. Furthermore, this system will prevent distortion of short-term spectral changes in high-level sounds such as frequency glides or formant transitions in speech and music. Since the compression channels will be narrow at low input levels, the system can provide adequate gain to low-level signals such as consonants in speech surrounded by spectral interferers. Furthermore, narrow channels at low levels will prevent objectionable modulation of steady background sounds by foreground sounds. If the system is sufficiently fast-acting, it can restore audibility of weak sounds rapidly following intense sounds such as weak consonants following intense vowels. It can also restore audibility in complex situations where multiple talkers are speaking at different levels. Hence, this system increases the potential for listening in both spectral and temporal dips, and taking into account the preservation of spectral contrast at high levels, it combines the advantages of both single-channel and multi-channel compression without suffering from their respective disadvantages.

It should be noted that an asymmetric widening of the compression channels towards the high-frequency side with increasing level can compensate specifically for increased upward spread of masking which is often observed in hearing-impaired listeners. High-frequency sound components falling into a given compression channel will reduce the gain applied to sound components at lower frequencies and thus reduce upward spread of masking.

In addition, the proposed system can normalize loudness perception in hearing-impaired listeners to a larger extent than prior systems. Normal-hearing listeners show a differential growth of loudness for narrowband and wideband sounds, due to the level-dependent bandwidth of auditory filters. For wideband stimuli at low levels, remote frequency components are compressed independently, since they fall into narrow, independent auditory filters. At higher levels, filters are broader and remote frequency components will be compressed jointly, even for wideband stimuli. As a consequence, differences in loudness between narrowband and wideband sounds decrease with increasing level. Since hearing-impaired listeners show broadened and more static auditory filters than normal-hearing listeners, they do not show the same differential growth of loudness. However, compression using channels which widen with increasing level can restore differential loudness growth for aided hearing-impaired listeners. The normalization of loudness perception may improve perceived sound quality as well as performance on involved auditory tasks such as speech perception in complex environments.

The combination of level-dependent channels and fast-acting compression also bears advantages in audio limiting and output compression limiting: If the instantaneous power in a given compression channel is high, the channel will be widened and thus, power summation across frequency is accounted for by this channel. This allows for a higher limiting threshold level (the level at which compression limiting is activated) and for a smaller clipping margin (the difference between the maximum allowed band output level and broadband saturation level), resulting in improved perceived sound quality.

The present subject matter is demonstrated for hearing aids. It is understood however, that the disclosure is not limited to hearing aids and that the teachings provided herein can be applied to a variety of audio processing and hearing assistance devices, including but not limited to, behind-the-ear (BTE), in-the-ear (ITE), in-the-canal (ITC), receiver-in-canal (RIC), or completely-in-the-canal (CIC) type hearing aids. It is understood that behind-the-ear type hearing aids may include devices that reside substantially behind the ear or over the ear. Such devices may include hearing aids with receivers associated with the electronics portion of the behind-the-ear device, or hearing aids of the type having receivers in the ear canal of the user, including but not limited to receiver-in-canal (RIC) or receiver-in-the-ear (RITE) designs. The present subject matter can also be used in hearing assistance devices generally, such as cochlear implant type hearing devices and such as deep insertion devices having a transducer, such as a receiver or microphone, whether custom fitted, standard, open fitted or occlusive fitted. It is understood that other hearing assistance devices not expressly stated herein may be used in conjunction with the present subject matter.

This application is intended to cover adaptations or variations of the present subject matter. It is to be understood that the above description is intended to be illustrative, and not restrictive. The scope of the present subject matter should be determined with reference to the appended claims, along with the full scope of legal equivalents to which such claims are entitled.

What is claimed is:

1. A hearing assistance device, comprising:
- a buffer adapted for receiving time-domain input signals;
- a frequency analysis module adapted to convert the time domain input signals into a plurality of subband signals;
- a power detector adapted to receive the subband signals and to provide a subband version of the input signals;
- a nonlinear gain stage adapted to apply gain to the plurality of subband versions of the input signals;
- a frequency synthesis module adapted to process subband signals from the nonlinear gain stage and to create a processed output signal;
- a filter for filtering the input signals and the output signal; and
- a level-dependent compression module adapted to adjust width of subbands based on a function of the detected power in the plurality of subband signals produced by the frequency analysis module.

2. The device of claim 1, wherein the level-dependent compression module includes level-dependent analysis channels to control a compressive-gain signal as a function of frequency.

3. The device of claim 2, wherein the level-dependent analysis channels include channels with level-dependent bandwidths.

4. The device of claim 1, wherein power from bands of a static bandwidth are weighted and summed according to signal level.

5. The device of claim 1, wherein the level-dependent compression module includes uniformly scaled analysis filterbanks.

6. The device of claim 1, wherein the level-dependent compression module includes non-uniformly scaled analysis filterbanks.

7. The device of claim 1, wherein the level-dependent compression module is adapted for compression of audio signals.

8. The device of claim 2, wherein the audio signals include speech.

9. The device of claim 1, wherein the audio signals include music.

10. A hearing assistance device, comprising:
- a buffer adapted for receiving a time domain input signal;
- a frequency analysis module adapted to convert the time domain input signal into a plurality of subband signals;
- a power detector adapted to receive the subband signals and to provide a subband version of the input signals;
- a nonlinear gain stage adapted to apply gain to the plurality of subband versions of the input signals;
- a frequency synthesis module adapted to process subband signals from the nonlinear gain stage and to create a processed output signal;
- a filter adapted for filtering the input signal and the output signal; and
- a level-dependent compression module adapted to add a weighted power of a subband signal to at least one other weighted subband signal power in an adjacent subband, and to provide a final instantaneous-power estimate $\tilde{P}_n$, the level-dependent compression module configured to adjust width of subbands based on the power estimate.

11. The device of claim 10, wherein the level-dependent compression module is adapted to provide a final instantaneous power estimate for power integration.

12. The device of claim 10, wherein the level-dependent compression module is adapted to provide a final instantaneous power estimate for nonlinear gain.

13. The device of claim 10, wherein the level-dependent compression module is adapted to provide a final instantaneous power estimate for frequency synthesis.

14. The device of claim 10, wherein the level-dependent compression module is adapted to provide a final instantaneous power estimate for time-domain filtering.

15. The device of claim 10, wherein the filter includes a finite impulse response (FIR) filter.

16. The device of claim 10, wherein the weighted power is determined using weights as a function of target bandwidth.

17. The device of claim 16, wherein the weights are symmetrically distributed across adjacent bands.

18. The device of claim 16, wherein the weights are asymmetrically distributed across adjacent bands.

19. The device of claim 10, wherein the level-dependent compression module includes an unbranched architecture.

20. The device of claim 10, wherein the level-dependent compression module includes a side-branched architecture.

* * * * *